US009187927B1

(12) United States Patent
Hamel

(10) Patent No.: US 9,187,927 B1
(45) Date of Patent: Nov. 17, 2015

(54) POST PULLING ATTACHMENT SYSTEM

(71) Applicant: Gerald G. Hamel, Bottineau, ND (US)

(72) Inventor: Gerald G. Hamel, Bottineau, ND (US)

( * ) Notice: Subject to any disclaimer, the term of this patent is extended or adjusted under 35 U.S.C. 154(b) by 367 days.

(21) Appl. No.: 13/644,495

(22) Filed: Oct. 4, 2012

(51) Int. Cl.
*E04H 17/26* (2006.01)
*E21D 15/00* (2006.01)

(52) U.S. Cl.
CPC ..... *E04H 17/265* (2013.01)

(58) Field of Classification Search
USPC ..... 254/29 R, 30, 100, 103, 133 R, 134; 414/724; 269/3, 6, 95
See application file for complete search history.

(56) References Cited

U.S. PATENT DOCUMENTS

| | | | | |
|---|---|---|---|---|
| 4,189,854 | A * | 2/1980 | Haynes | 37/404 |
| 4,612,740 | A * | 9/1986 | Yamamoto | 248/225.11 |
| 5,239,810 | A * | 8/1993 | Gugel | 56/10.8 |
| 5,242,152 | A | 9/1993 | Schatz | |
| 5,896,760 | A * | 4/1999 | Osburn | 70/19 |
| 6,056,271 | A | 5/2000 | Riojas | |
| 6,641,347 | B2 | 11/2003 | Ewington | |
| 6,669,172 | B1 * | 12/2003 | Bearden | 254/30 |
| 6,857,619 | B1 | 2/2005 | Jangula | |
| 7,909,349 | B2 * | 3/2011 | Rasset et al. | 280/462 |
| 7,926,786 | B2 | 4/2011 | Slagle | |
| 8,480,058 | B2 * | 7/2013 | Matthews | 254/30 |
| 2010/0307011 | A1 * | 12/2010 | Hurley et al. | 30/320 |
| 2011/0206457 | A1 * | 8/2011 | Schoon | 405/1 |
| 2012/0260463 | A1 * | 10/2012 | Hines | 16/430 |

* cited by examiner

*Primary Examiner* — Joseph J Hail
*Assistant Examiner* — Jon Taylor
(74) *Attorney, Agent, or Firm* — Neustel Law Offices

(57) ABSTRACT

A post pulling attachment system which easily attaches and detaches from a bucket to aid in safely and efficiently removing a post from the ground. The post pulling attachment system generally includes an outer securing plate and an inner securing plate which are positioned on either side of a bucket. Each of the securing plates includes a plurality of corresponding apertures through which a pair of removal members are extended both to secure the present invention to the bucket and to aid in removing a post. When installed, the removal members will extend outwardly from the bucket in spaced-apart relationship. By positioning a post between the removal members, rotating the bucket to jam the post therein and then lifting the bucket, a post may safely and efficiently be removed from the ground without use of a chain.

8 Claims, 9 Drawing Sheets

POST PULLING ATTACHMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a post pulling attachment and more specifically it relates to a post pulling attachment system which easily attaches and detaches from a bucket to aid in safely and efficiently removing a post from the ground.

2. Description of the Related Art

Any discussion of the related art throughout the specification should in no way be considered as an admission that such related art is widely known or forms part of common general knowledge in the field.

Posts are often used in constructing fences and the like. Due to the posts' effect on the structural integrity of a supported system (such as a fence), it is extremely important that such installed posts be firmly and securely anchored in the ground. Typically, posts are buried within the ground such that at least a third of the length is below-grade for support of the above-grade post. Further, a cement footing is generally poured around the base of the post to further secure the post in the ground.

While such methods have been successfully utilized to secure a post firmly in the ground, such posts are often required to be removed for replacement or other reasons. The methodology utilized to secure the post firmly in the ground also has the side-effect of making removal of the post exceedingly difficult.

In the past, such posts have had to be manually dug out or, in some cases, ripped out from the ground using a chain secured to a vehicle such as a skid steer loader. While using such a method has proven effective, the risks of injury related to usage of a chain, which can often break or move erratically after removal, is extremely high.

Because of the inherent problems with the related art, there is a need for a new and improved post pulling attachment system which easily attaches and detaches from a bucket to aid in safely and efficiently removing a post from the ground.

BRIEF SUMMARY OF THE INVENTION

The invention generally relates to a post pulling attachment which includes an outer securing plate and an inner securing plate which are positioned on either side of a bucket. Each of the securing plates includes a plurality of corresponding apertures through which a pair of removal members are extended both to secure the present invention to the bucket and to aid in removing a post. When installed, the removal members will extend outwardly from the bucket in spaced-apart relationship. By positioning a post between the removal members, rotating the bucket to jam the post therein and then lifting the bucket, a post may safely and efficiently be removed from the ground without use of a chain. There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
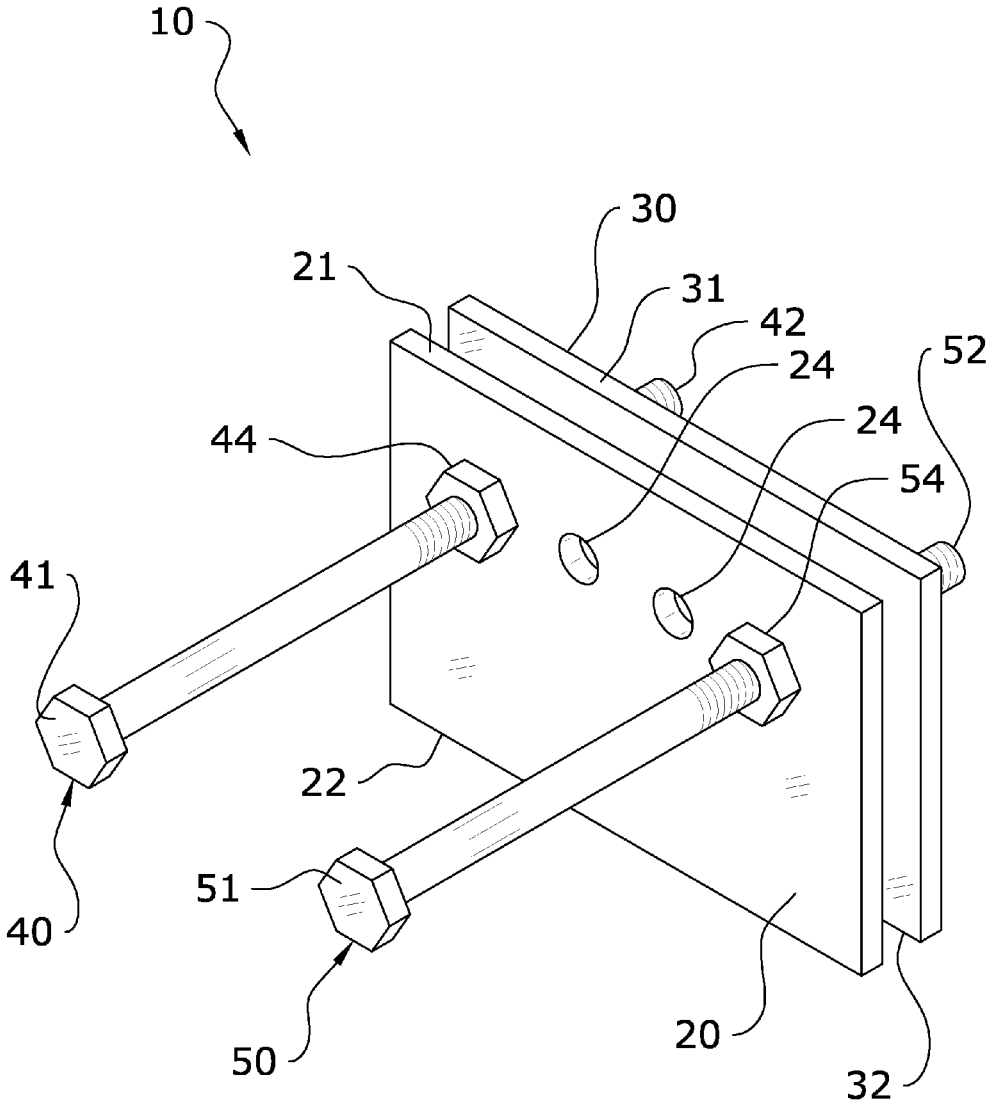
FIG. 1 is a frontal upper perspective view of the present invention.

Turning now descriptively to the drawings, in which similar reference characters denote similar elements throughout the several views, FIGS. 1 through 10 illustrate a post pulling attachment system 10, which comprises an outer securing plate 20 and an inner securing plate 30 which are positioned on either side of a bucket 12. Each of the securing plates 20, 30 includes a plurality of corresponding apertures 24, 34 through which a pair of removal members 40, 50 are extended both to secure the present invention to the bucket 12 and to aid in removing a post 15. When installed, the removal members 40, 50 will extend outwardly from the bucket 12 in spaced-apart relationship. By positioning a post 15 between the removal members 40, 50, rotating the bucket 12 to jam the post 15 therein and then lifting the bucket 12, a post 15 may safely and efficiently be removed from the ground without use of a chain.

The present invention is adapted primarily for use in combination with a bucket 12 as is commonly present on skid steer loaders and other working vehicles. While the figures illustrate an exemplary embodiment secured to such a bucket 12, it is appreciated that the present invention and its principles may be applied to a wide range of structures. Thus, the scope of the present invention should not be construed as being limited to applications involving the usage of buckets 12. The securing plates 20, 30 may be secured to a number of structures.

B. Securing Plates

Figure 2:
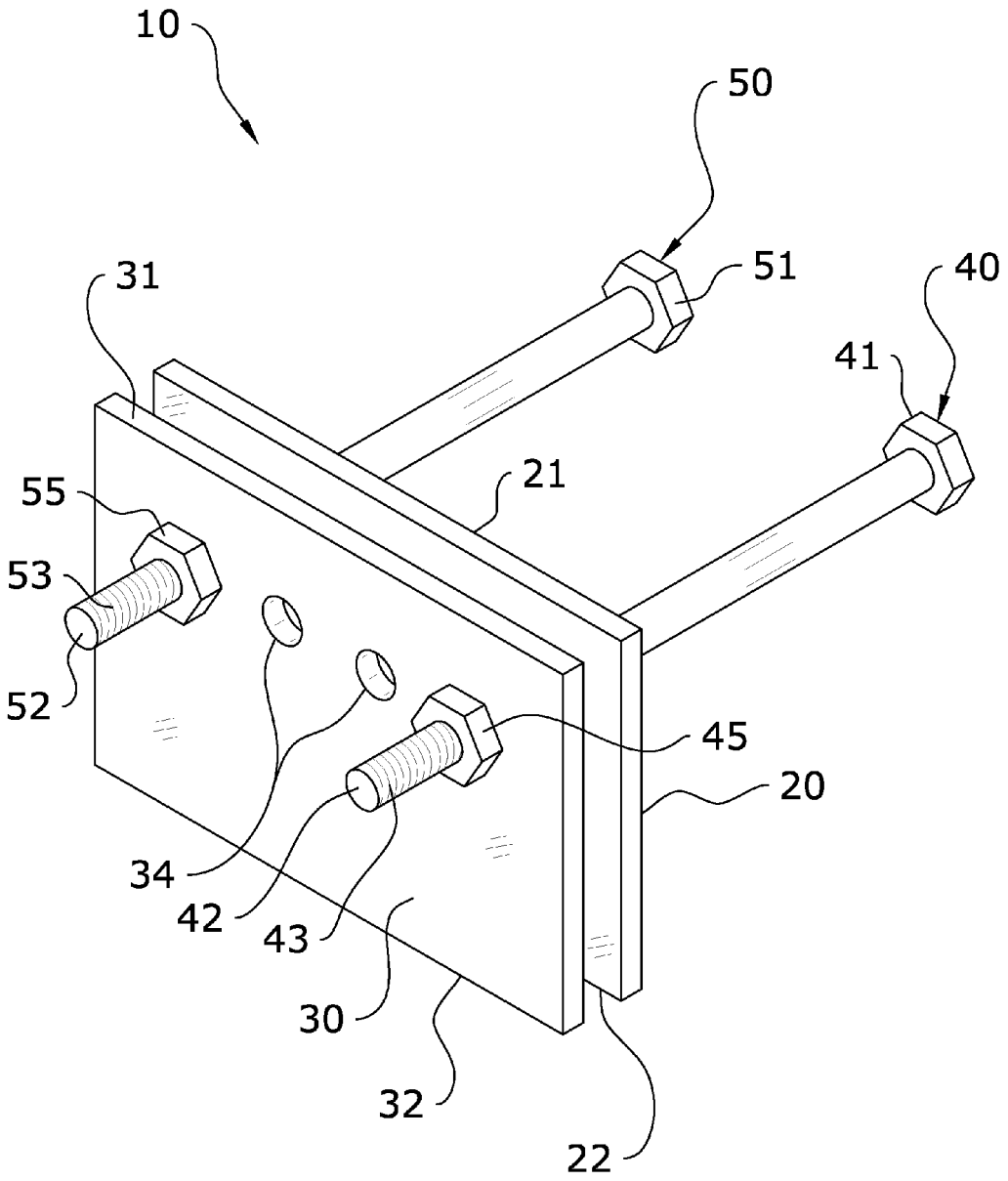
FIG. 2 is a rear upper perspective view of the present invention.
Figure 3:
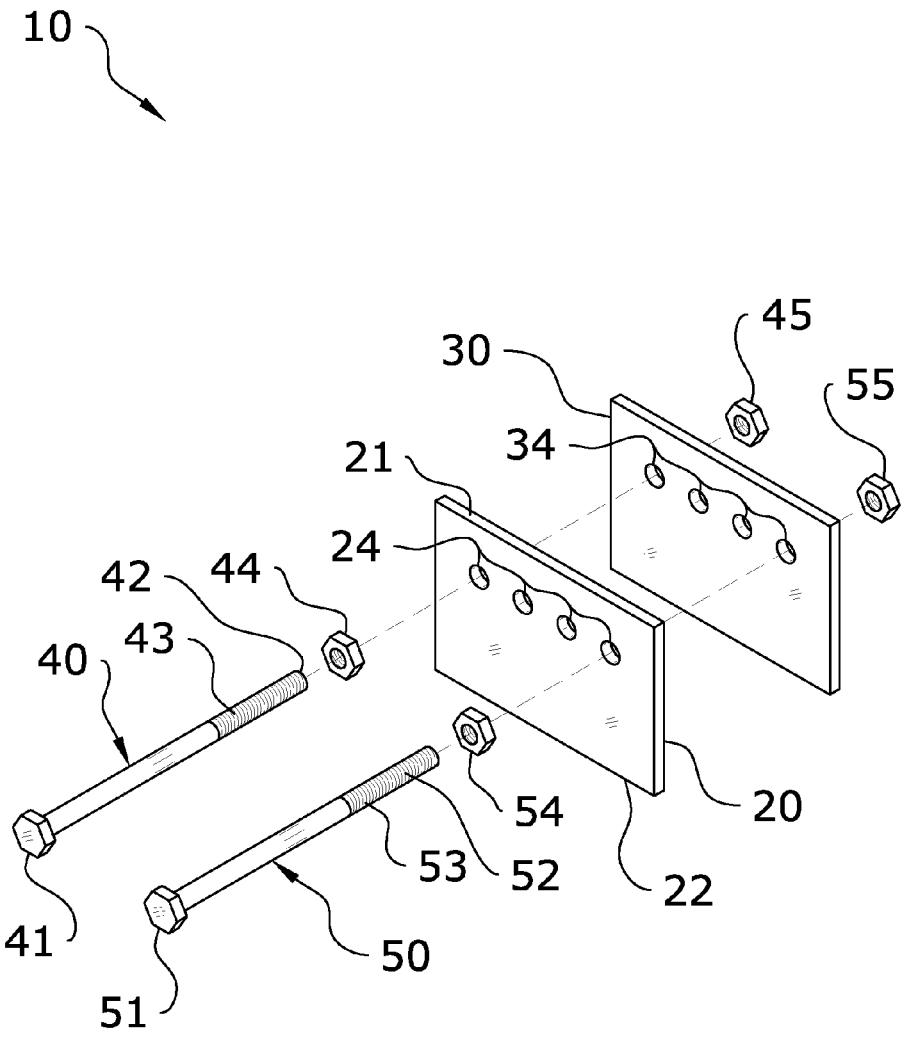
FIG. 3 is an exploded view of the components of the present invention.
Figure 4:
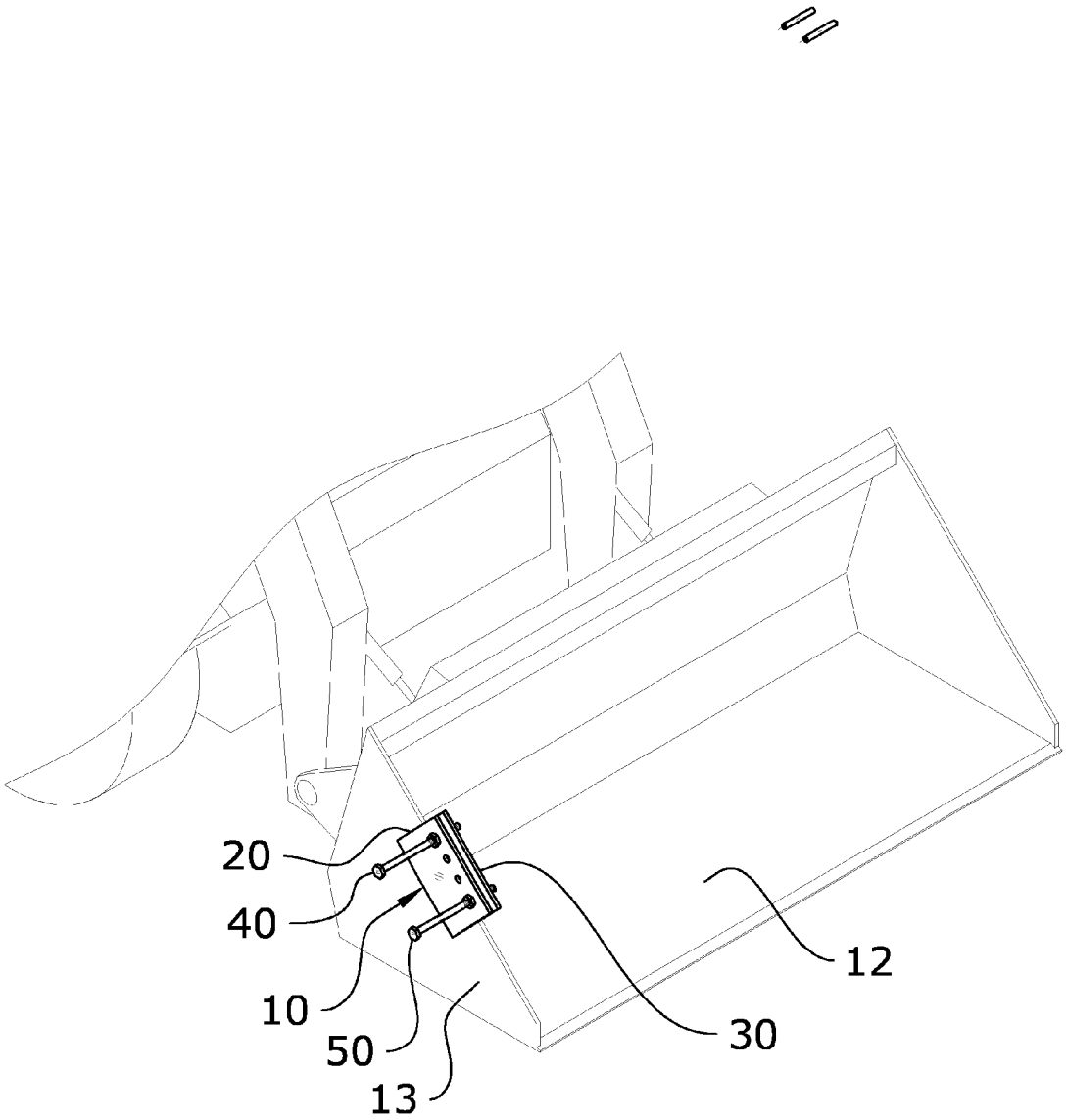
FIG. 4 is an upper perspective view of the present invention installed on a bucket.

As best shown in FIGS. 1-3, the present invention is comprised of a pair of securing plates 20, 30 which are utilized to securely mount the present invention to a structure such as a bucket 12 of a loader. As shown in FIG. 4, the present invention will generally be removably secured to a sidewall 13 of the bucket 12.

Figure 5:
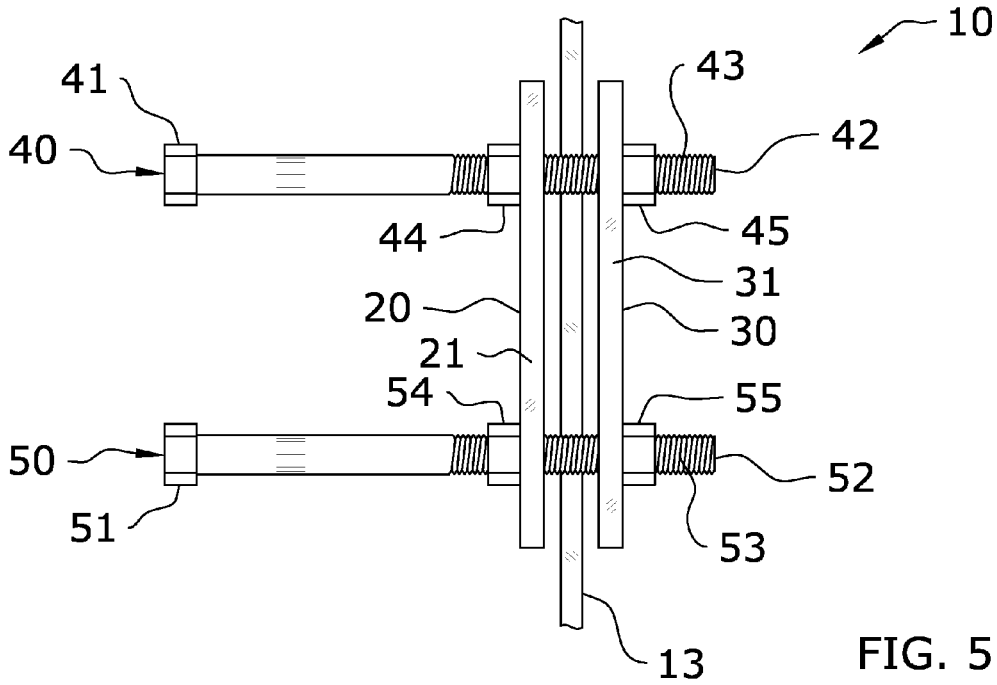
FIG. 5 is a top view of the present invention.
Figure 6:
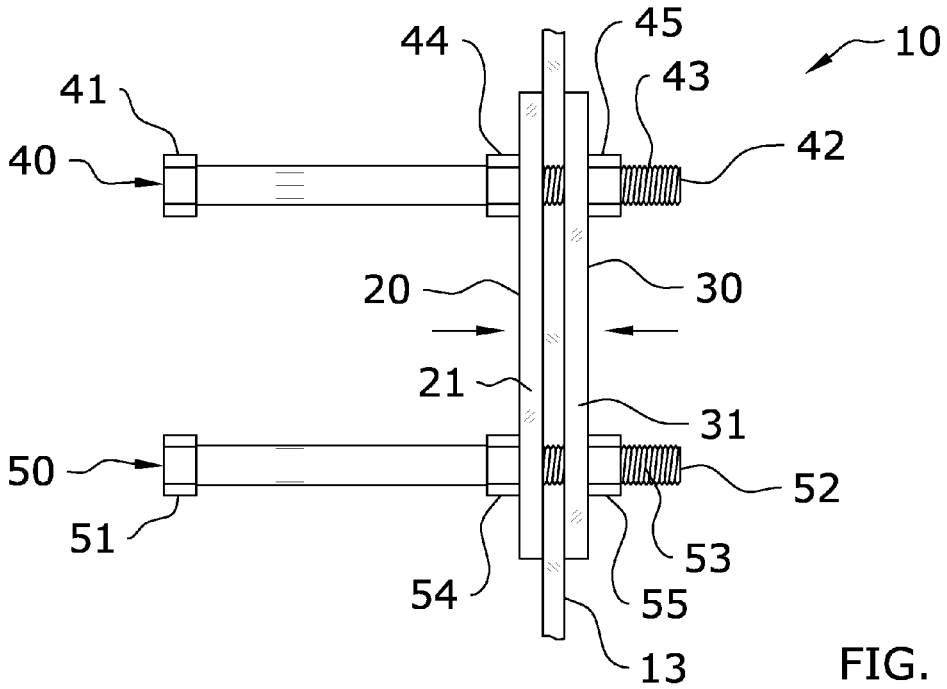
FIG. 6 is a top view of the present invention illustrating its installation on a bucket.

The pair of securing plates 20, 30 is generally comprised of an outer securing plate 20 which is secured against an outer surface of the bucket sidewall 13 and an inner securing plate 30 which is secured against an inner surface of the bucket sidewall 13. As shown in FIGS. 5 and 6, the bucket sidewall 13 is sandwiched between the inner and outer securing plates 20, 30 when the present invention is installed.

The securing plates 20, 30 are each preferably comprised of substantially flat, rectangular members, each having an upper end 21, 31 and a lower end 22, 32. However, it is appreciated that various other shapes may be utilized, and the present invention should not be construed as being limited to rectangular securing plates 20, 30.

Both securing plates 20, 30 generally include a plurality of apertures 24, 34 through which the removal members 40, 50 of the present invention will extend both to secure the present invention to the bucket 12 as well as to assist in the removal of posts 15. As shown in FIG. 3, the outer securing plate 20 will generally include a plurality of apertures 34 extending horizontally adjacent its upper end 21 and the inner securing plate 30 will similarly include a plurality of apertures extending horizontally adjacent its upper end 31. It is appreciated that the numbering, orientation and placement of the apertures 24, 34 may vary for different applications or to suit different buckets 12. The placement of the apertures 24 on the outer securing plate 20 should align with the placement of the apertures 34 on the inner securing plate 30 so that the removal members 40, 50 may pass freely through both plates 20, 30 simultaneously.

Figure 10:
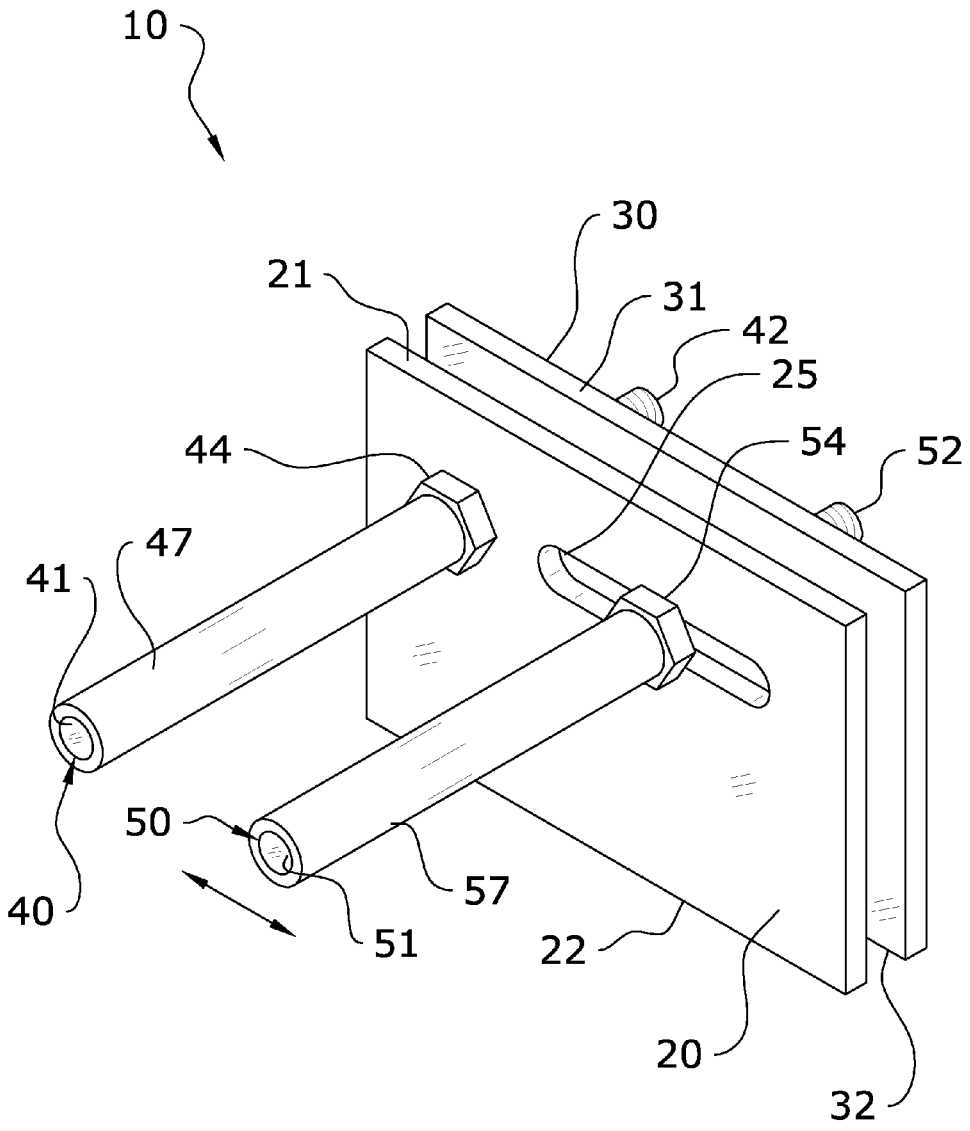
FIG. 10 is an upper perspective view of an alternate embodiment of the present invention.

In an alternate embodiment as shown in FIG. 10, one or more slots 25 may be included on the securing plates 20, 30 instead of apertures 24, 34. In other embodiments, a combination of apertures 24, 34 and slots 25 may be provided for further adjustability.

C. Removal Members

As best shown in FIGS. 1-3, the present invention includes a pair of removal members 40, 50 which extend outwardly from the securing plates 20, 30 in a spaced-apart relationship so as to define a slot therebetween in which a post 15 will be positioned during removal operations. Each of the removal members 40, 50 is comprised of an elongated member such as a bolt or other rigid elongated device. The removal members 40, 50 will preferably be comprised of an extremely rigid and durable material so as to withstand the force necessary to remove a reinforced post 15 without becoming damaged, warped or broken.

Generally, a first removal member 40 will extend through both the first and second securing plates 20, 30 through a first aperture 24, 34 on each and a second removal member 50 will extend through both of the plates 20, 30 through a second aperture 24, 34 on each as shown in FIG. 1.

The first removal member 40 preferably includes a bolt head at its first end 41 and a threaded portion adjacent its second end 43. Similarly, the second removal member 50 preferably includes a bolt head at its first end 51 and a threaded portion adjacent its second end 53. Preferably, the first removal member 40 will mirror the structure of the second removal member 50.

FIGS. 1 and 2 illustrate the present invention as constructed. The first removal member 40 is extended through a corresponding aperture 24, 34 on each of the plates 20, 30. A first nut 44 is tightened around the threaded portion 43 of the first removal member 40 adjacent the outer securing plate 20 and a second nut 45 is tightened around the threaded portion 43 of the first removal member 40 adjacent the inner securing plate 30 as shown in FIG. 1.

Similarly, the second removal member 50 is extended through a corresponding aperture 24, 34 on each of the plates 20, 30. The apertures 24, 34 utilized for the second removal member 50 will be different from those which are utilized for the first removal member 40 to ensure that the removal members 40, 50 are horizontally offset. A first nut 54 is tightened around the threaded portion 53 of the second removal member 50 adjacent the outer securing plate 20 and a second nut 55 is tightened around the threaded portion 53 of the second removal member 50 adjacent the inner securing plate 30 as shown in FIG. 1. Thus, the plates 20, 30 may be tightened around a bucket sidewall 13 as shown in FIGS. 4-6.

In some embodiments, a sheath 47, 57 may be provided for one or both of the removal members 40, 50. The sheaths 47, 57 are comprised of hollow, elongated members which cover the exposed portion of the removal members 40, 50 as shown in FIG. 1. Preferably, the sheaths 47, 57 will be comprised of rubber or other non-slip substances which will ensure a tight, frictional engagement between the removal members 40, 50 and the post 15 being removed when the present invention is in use.

D. Operation of Preferred Embodiment

Figure 7:
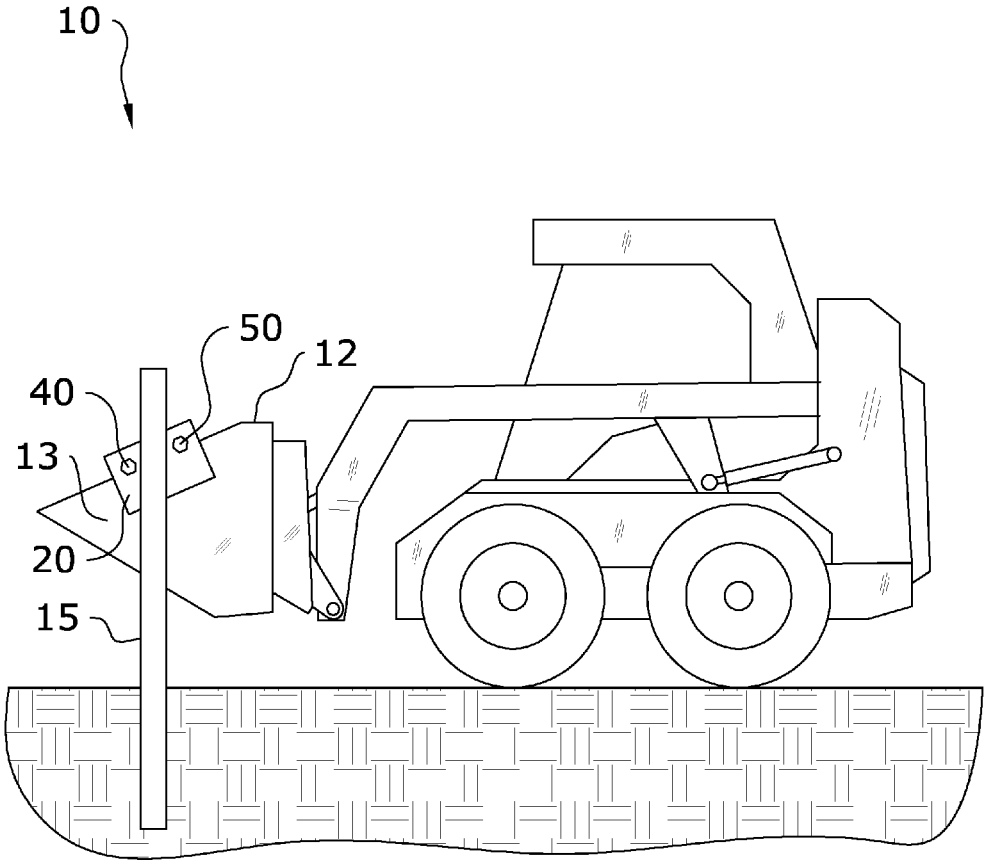
FIG. 7 is a side view of the present invention being lowered over a post.
Figure 8:
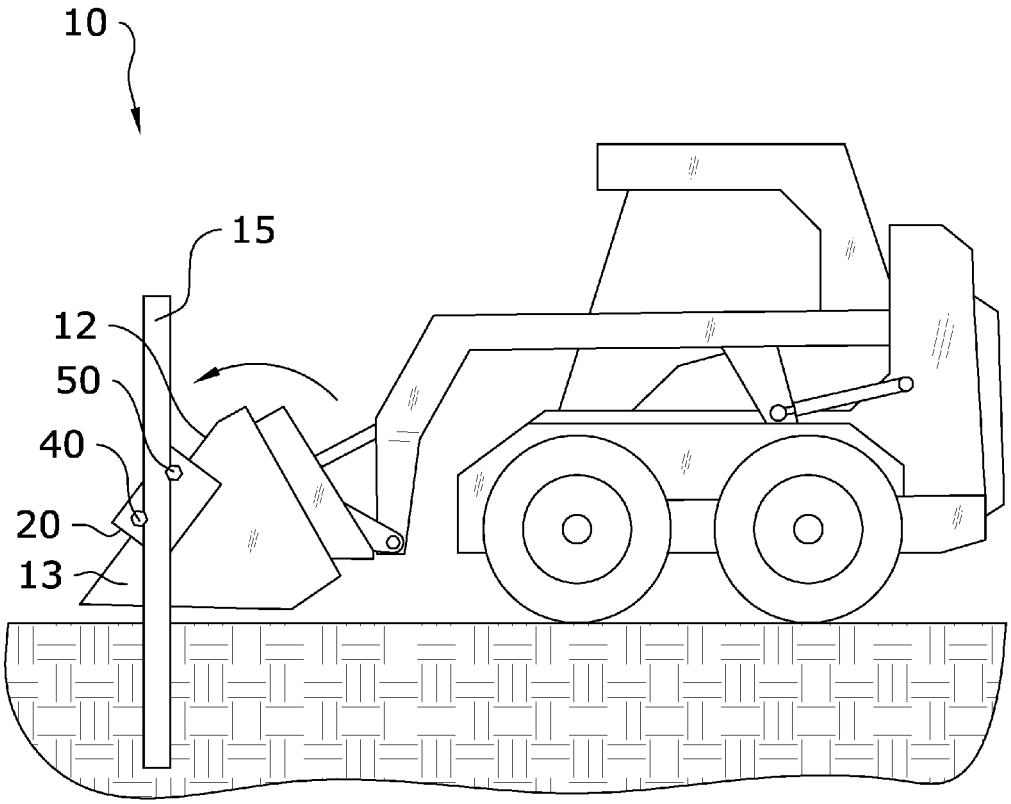
FIG. 8 is a side view of the present invention secured over a post.
Figure 9:
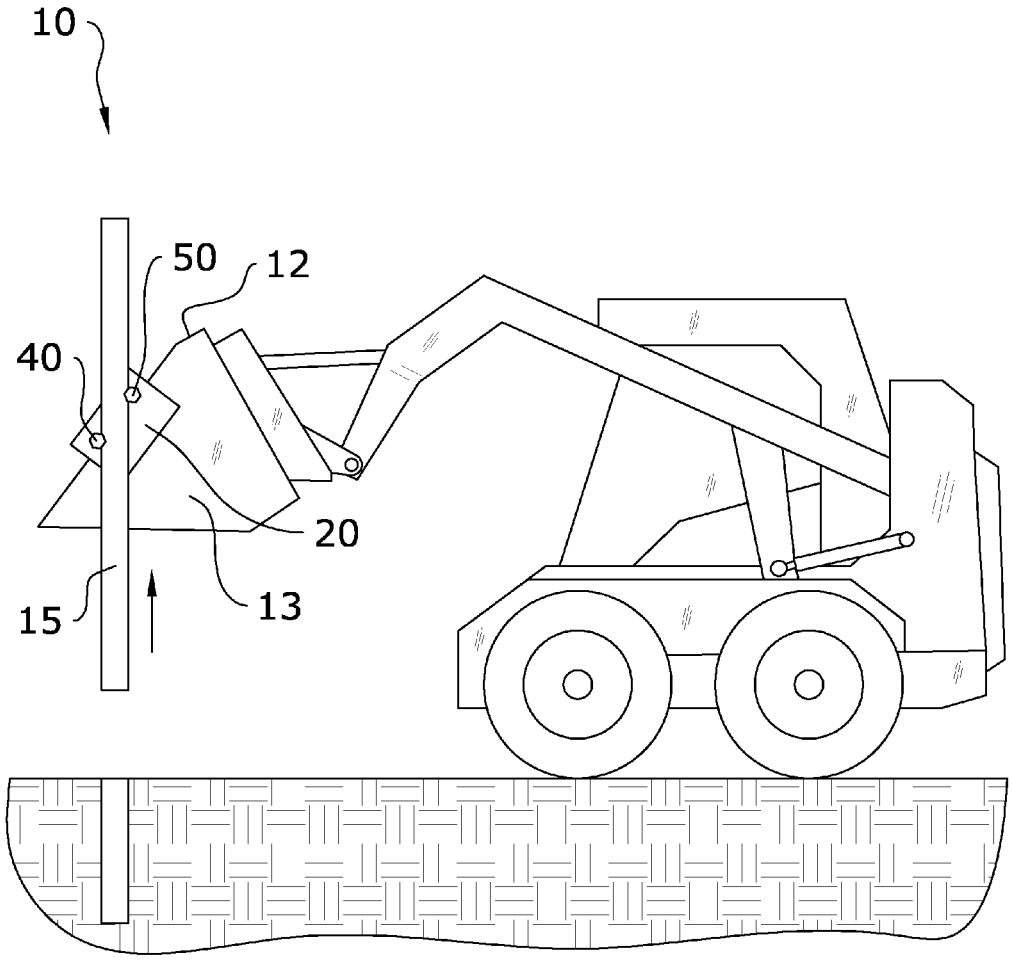
FIG. 9 is a side view of the present invention in use removing a post.

FIGS. 7-9 illustrate the present invention in use removing a post 15. First, the present invention is installed to the bucket sidewall 13 by positioning the securing plates 20, 30 on either side of the sidewall 13 and securing thereto by extending the removal members 40, 50 through the apertures 24, 34 and securing with the nuts 44, 45, 54, 55. After installation, the removal members 40, 50 should extend outwardly from the side of the bucket 12 as shown in FIG. 4.

With the present invention installed on the bucket 12, the bucket 12 is then lowered such that a post 15 is positioned between the removal members 40, 50 as shown in FIG. 7. The bucket 12 is then rotated slightly to jam the post 15 between the two removal members 40, 50 as shown in FIG. 8. The bucket 12 may then be raised to lift the post 15 out of the ground as shown in FIG. 9.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A post pulling attachment system, comprising:

a bucket for a working vehicle, wherein said bucket includes a sidewall having a first side and a second side, wherein said first side is opposite said second side;

an outer securing plate secured to said first side of a sidewall of said bucket, wherein said outer securing plate includes a first aperture and a slot;

an inner securing plate secured to said second side of said sidewall of said bucket, wherein said inner securing plate includes a second aperture and a third aperture;

a first removal member extending through said first aperture of said outer securing plate and said second aperture of said inner securing plate, wherein said first removal member comprises a first elongated bolt; and a second removal member extending through said slot of said outer securing plate and said third aperture of said inner securing plate, wherein said second removal member comprises a second elongated bolt, wherein said first removal member and said second removal member extend parallel with respect to each other outwardly from said first side of said bucket.

2. The post pulling attachment system of claim 1, wherein said plurality of apertures of said outer securing plate extend along an upper end of said outer securing plate.

3. The post pulling attachment system of claim 2, wherein said first and second apertures of said inner securing plate extend along an upper end of said inner securing plate.

4. The post pulling attachment system of claim 1, wherein said first removal member includes a head at its first end and a threaded portion adjacent its second end.

5. The post pulling attachment system of claim 4, wherein said second removal member includes a head at its first end and a threaded portion adjacent its second end.

6. The post pulling attachment system of claim 1, further comprising a first sheath for covering said first removal member.

7. The post pulling attachment system of claim 6, further comprising a second sheath for covering said second removal member.

8. The post pulling attachment system of claim 7, wherein said first sheath and said second sheath are each comprised of rubber.

* * * * *